US007100866B2

(12) United States Patent
Rehkemper et al.

(10) Patent No.: US 7,100,866 B2
(45) Date of Patent: Sep. 5, 2006

(54) CONTROL SYSTEM FOR A FLYING VEHICLE

(75) Inventors: Jeffrey Rehkemper, Chicago, IL (US); Nicholas Grisolia, Chicago, IL (US); Peter Greenley, Chicago, IL (US); Bret Gould, Chicago, IL (US)

(73) Assignee: Rehco, LLC, Chicago, IL (US)

( * ) Notice: Subject to any disclaimer, the term of this patent is extended or adjusted under 35 U.S.C. 154(b) by 0 days.

(21) Appl. No.: 11/035,606

(22) Filed: Jan. 14, 2005

(65) Prior Publication Data

US 2006/0157615 A1 Jul. 20, 2006

(51) Int. Cl.
*B64C 27/57* (2006.01)
*B64C 11/02* (2006.01)

(52) U.S. Cl. ..... 244/17.13; 416/141; 446/37

(58) Field of Classification Search ..... 244/17.11, 244/17.13, 17.25; 342/113, 171; 416/43, 416/44, 141; 701/7; 446/37, 36
See application file for complete search history.

(56) References Cited

U.S. PATENT DOCUMENTS 333,805 A * 1/1886 Yagn ..... 416/141
2,256,918 A * 9/1941 Young ..... 416/43
2,344,266 A * 3/1944 Hans ..... 416/132 R
2,382,431 A * 8/1945 Loth et al. ..... 416/18
2,650,046 A * 8/1953 Vanderlip ..... 244/17.13
2,873,075 A * 2/1959 Mooers et al. ..... 244/17.13
2,957,687 A * 10/1960 Chillson et al. ..... 123/403
3,093,807 A * 6/1963 Crane et al. ..... 367/95
3,102,263 A * 8/1963 Meyer ..... 342/113
3,375,518 A * 3/1968 Mader et al. ..... 342/171
5,195,039 A * 3/1993 Gold et al. ..... 701/7
5,371,581 A * 12/1994 Wangler et al. ..... 356/5.01
5,634,839 A * 6/1997 Dixon ..... 446/37
6,260,796 B1 * 7/2001 Klingensmith ..... 244/23 R

* cited by examiner

*Primary Examiner*—Galen Barefoot

(57) ABSTRACT

In one embodiment of the present invention there is described a vehicle having a propeller mechanism for propelling the vehicle in a horizontal direction. The vehicle includes a transmitter positioned on the bottom of the vehicle for transmitting a signal from the vehicle downwardly away from the vehicle. A receiver is positioned on the bottom of the vehicle for receiving the signal as it is bounced off of a surface, defined as a bounced signal. A control system is also provided that automatically sets a speed of the propeller mechanism in response to the receiver. The control system sets the speed of the propeller mechanism to a first speed when the receiver receives the bounced signal and the control system sets the speed of the propeller mechanism to a second speed when the receiver does not receive the bounced signal. The first speed is predefined as a speed that causes the vehicle to gain altitude, while the second speed is predefined as a speed that causes the vehicle to lose altitude. When the vehicle reaches a predetermined distance away from the surface of the object, the vehicle will hover at the predetermined distance as the control system toggles between the first and second speeds.

17 Claims, 10 Drawing Sheets

190
190
192
110
192
190
190
105
100
120

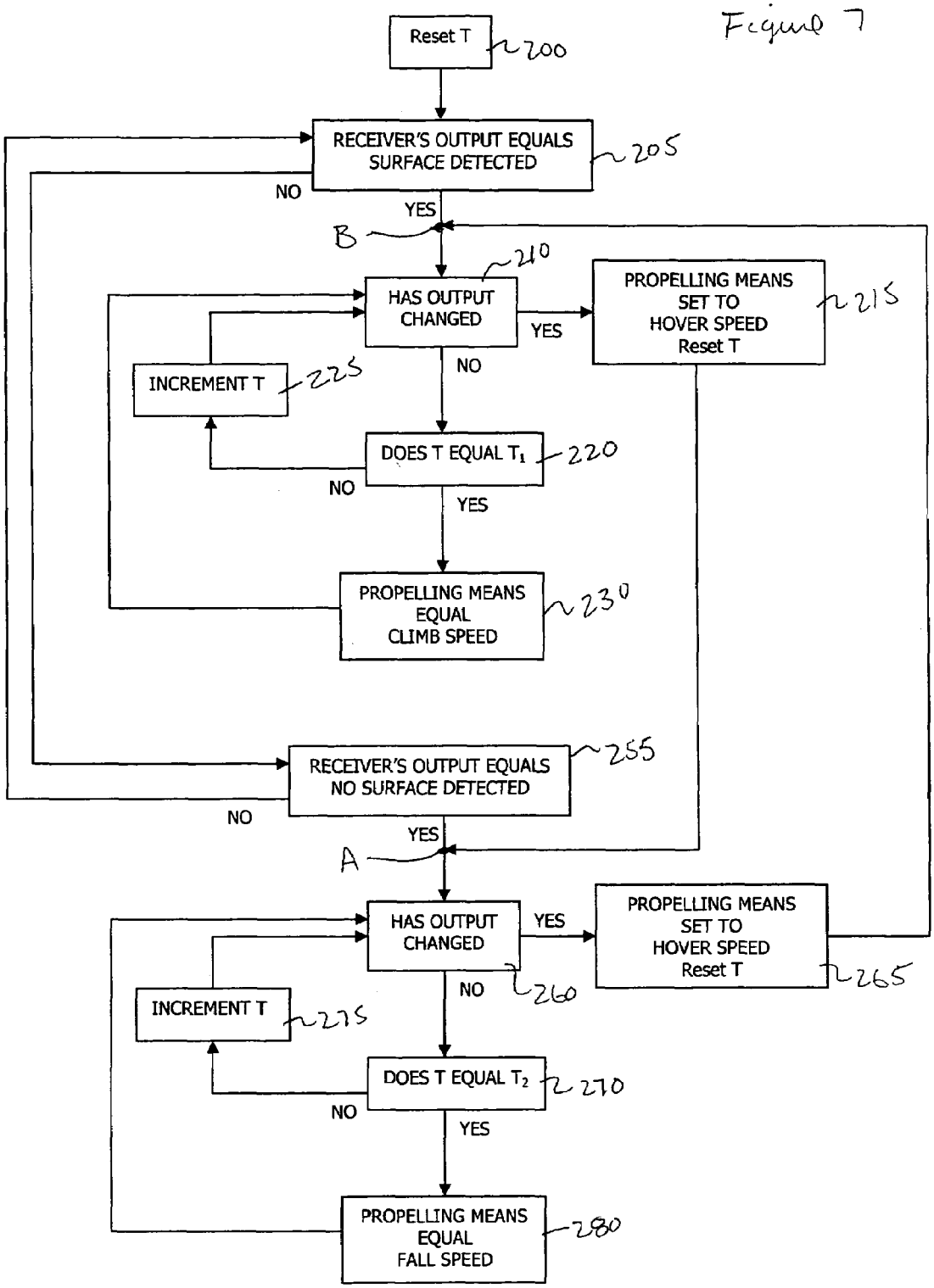
Figure 7
Reset T
200
RECEIVER'S OUTPUT EQUALS SURFACE DETECTED
205
NO
YES
B
210
HAS OUTPUT CHANGED
YES
PROPELLING MEANS SET TO HOVER SPEED Reset T
215
NO
INCREMENT T
225
DOES T EQUAL $T_1$
220
NO
YES
PROPELLING MEANS EQUAL CLIMB SPEED
230
RECEIVER'S OUTPUT EQUALS NO SURFACE DETECTED
255
NO
YES
A
HAS OUTPUT CHANGED
YES
PROPELLING MEANS SET TO HOVER SPEED Reset T
265
NO
260
INCREMENT T
275
DOES T EQUAL $T_2$
270
NO
YES
PROPELLING MEANS EQUAL FALL SPEED
280

CONTROL SYSTEM FOR A FLYING VEHICLE

FIELD OF THE INVENTION

This invention relates generally to a flying vehicle and more specifically to a hovering vehicle that includes a control system to automatically control the height of the vehicle above a surface or another object.

BACKGROUND OF THE INVENTION

While the present invention is related in part to vehicles developed in the toy and hobby industry, there are many types of vehicles that use propellers as a source of lift or as a means for propulsion for which the present invention is applicable. The more common types of these vehicles, which use propellers as a source of propulsion or lift, are air/space based vehicles such as airplanes, helicopters, or unconventional aircraft.

For example, U.S. Pat. No. 5,609,312 is directed to a model helicopter that describes an improved fuselage with a structure that supports radio-control components, and drive train components in an attempt to provide a simple structure; U.S. Pat. No. 5,836,545 is directed to a rotary wing model aircraft that includes a power distribution system that efficiently distributes engine power to the rotary wings and tail rotor system; U.S. Pat. No. 5,879,131 is directed to a main propeller system for model helicopters, which are capable of surviving repeated crashes; and U.S. Pat. No. 4,604,075 is directed to a toy helicopter that includes a removable control unit, which a user may plug into the toy helicopter.

In addition, the ability to maintain a stable flight or hover is difficult to implement without the user constantly adjusting the speed of the propellers. A self-hovering vehicle would be capable of adjusting itself to a predetermined height above another a surface or object, even when the object changes the distance between itself and the hovering vehicle.

SUMMARY OF THE INVENTION

A vehicle is provided with a self-hovering control mechanism to control the height of the vehicle above a surface or another object. The vehicle includes a means for propelling the vehicle in a horizontal direction. A transmitter positioned on the bottom of the vehicle transmits a signal from the vehicle downwardly away from the vehicle. A receiver is also positioned on the bottom of the vehicle for receiving the signal as it is bounced off of a surface. A control system is provided that automatically sets a speed of the propelling means in response to the receiver. The control system sets the speed of the propelling means to a first speed when the receiver receives the bounced signal and the control system sets the speed of the propelling means to a second speed when the receiver does not receive the bounced signal. The first speed being predefined as a speed that causes the vehicle to gain altitude and the second speed being predefined as a speed that causes the vehicle to lose altitude. The vehicle will position itself at a predetermined distance away from the object, by toggling between the two speeds when the bounced signal becomes intermittent.

In another embodiment the vehicle includes a horizontal stabilizing counter rotating propeller assembly secured to the vehicle. The counter rotating propeller assembly includes a pair of stacked rotor assemblies. Each rotor assembly includes a centered propeller mount with blades extending from the centered propeller mount. A ball joint with pins extending from the ball joint is also provided. A cap is secured to the centered propeller mount for capturing the ball joint between the cap and the centered propeller mount. The centered propeller mount and the cap include channels when assembled for receipt of the pins of the ball joint. When a rotor assembly begins to pitch, the pins of the ball joint contact interior walls defined by the channels to limit the pitch of the rotor assembly.

In yet another embodiment, a process of controlling an altitude of a flying vehicle having a vertical propelling means in a vertical direction is provided. The process includes providing a hover speed of the propelling means that has a tendency to maintain the vehicle at a substantially constant altitude. Transmitting a signal downwardly away from the vehicle and providing a means for receiving the signal as it is bounced off of a surface. The process monitors the receiving means and adjusts the propelling means in response to the following conditions. First, when the receiving means does not receive the bounced signal for a predetermined time, the propelling means is adjusted to a speed lower than the hover speed. Second, when the receiving means receives the bounced signal for a predetermined time, the propelling means is adjusted to a speed higher than the hover speed. Third, the propelling means is adjusting to the hover speed when the receiving means changes from receiving the bounced signal to not receiving the bounced signal and visa versa.

Numerous advantages and features of the invention will become readily apparent from the following detailed description of the invention and the embodiments thereof, and from the accompanying drawings.

BRIEF DESCRIPTION OF THE DRAWINGS

A fuller understanding of the foregoing may be had by reference to the accompanying drawings, wherein:

FIG. 7 is a control system diagram of the hovering control system.

DETAILED DESCRIPTION OF THE INVENTION

Figure 1:
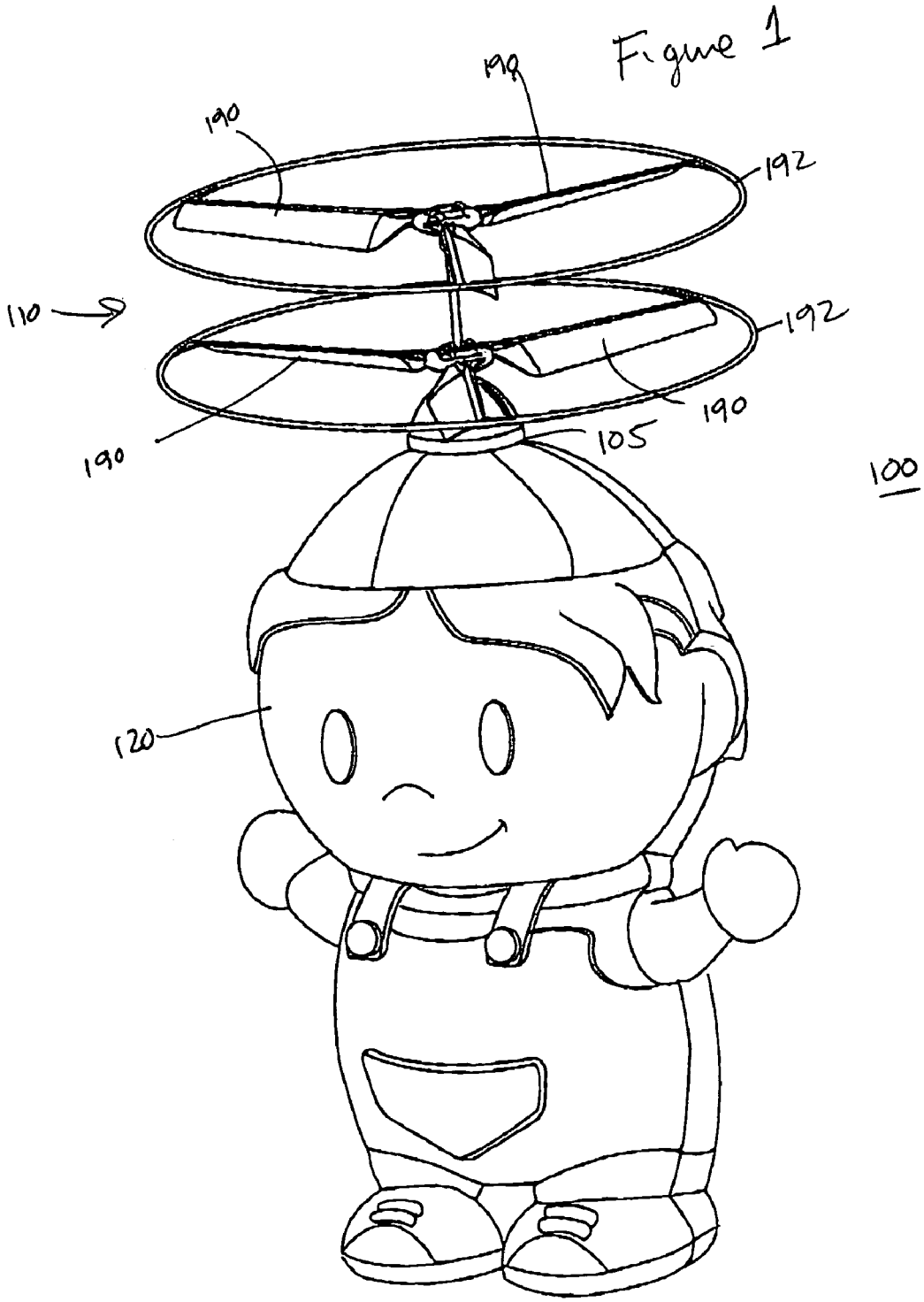
FIG. 1 is a perspective view of a figure with a counter-rotating propelling means and a automatic hovering control system.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or the embodiments illustrated.

Figure 2:
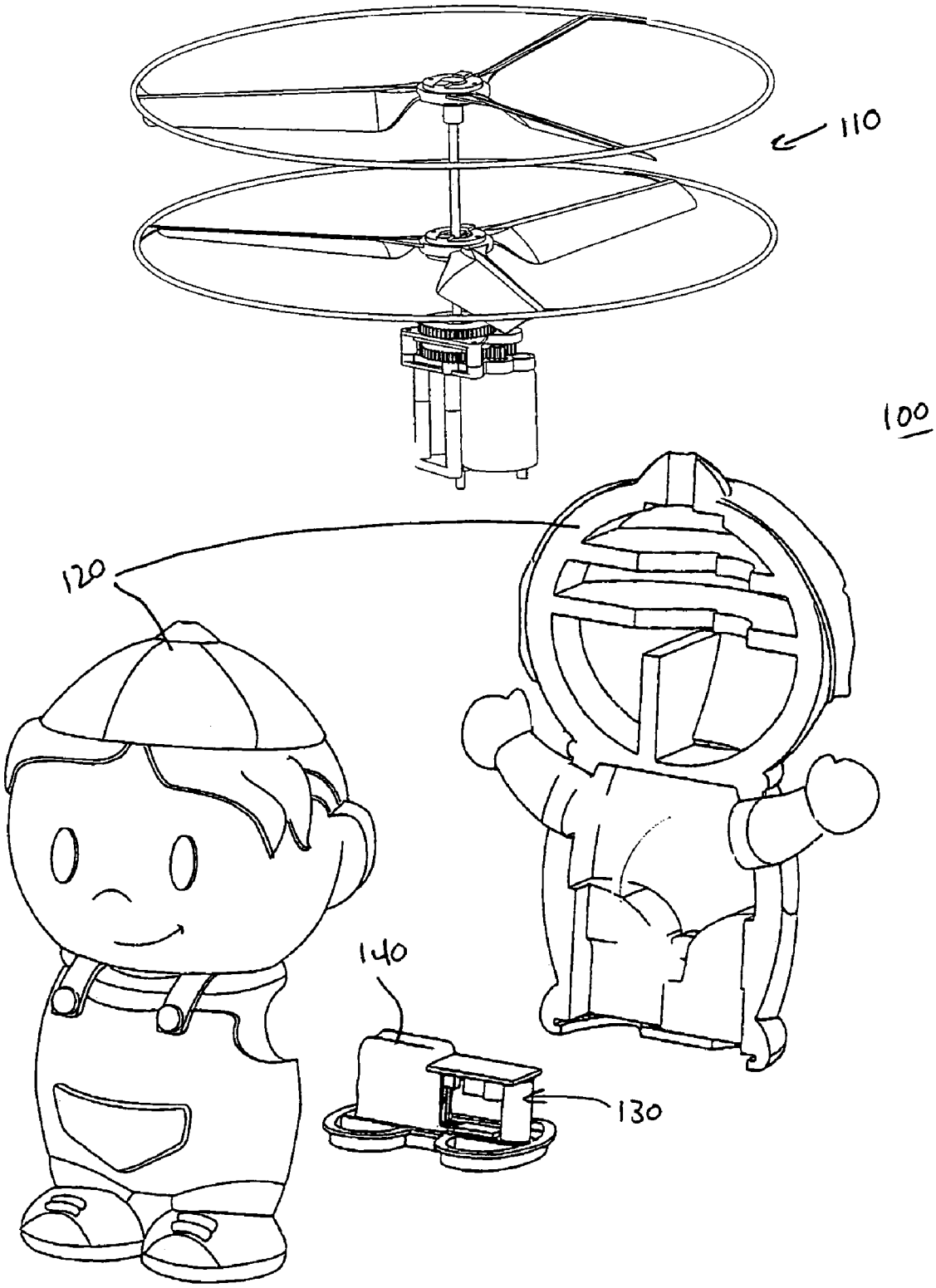
FIG. 2 is a partially exploded view of FIG. 1.

Referring now to FIGS. 1 and 2 a vehicle 100 is provided with a system to control the height or distance of the vehicle away from a surface or another object. The vehicle 100 includes a means for propelling 110 the vehicle 100 in a specified direction, an airframe or body 120, the control system 130, and a power supply 140.

In the present invention the propelling means 110 is a counter-rotating propeller assembly. However, the propelling means may be replaced with a single rotor assembly and a separate counter-torque assembly such as but not limited to a tail rotor if such was being implemented in a helicopter. Alternatively, a single rotor assembly may be used by itself if the vehicle was completely rotating such as a flying saucer.

Figure 3A:
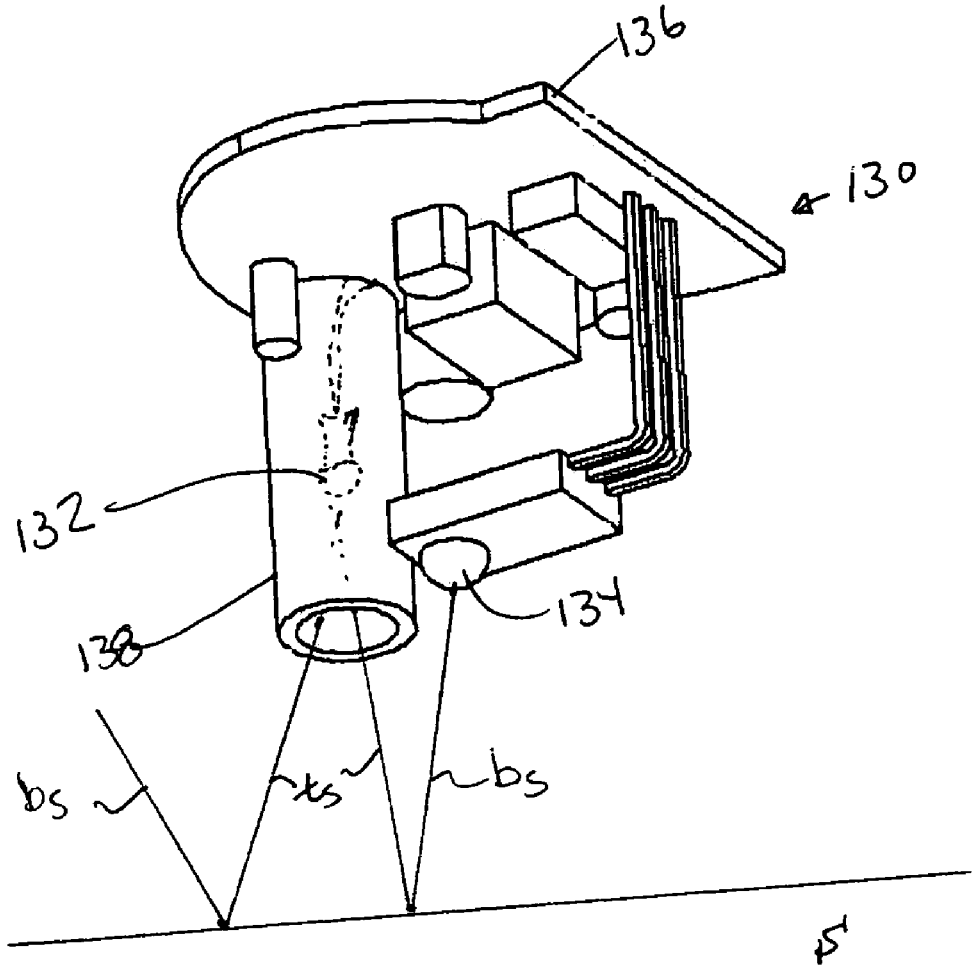
FIG. 3*a* is an enlarged view of the hovering control system.

Referring now to FIG. 3*a*, the control system 130 includes a transmitter 132 and a receiver 134 in communication with a circuit board 136 which is further in communication with and control of the propelling means 110. The transmitter and receiver pair are preferably an infra-red pair, however other transmitter/receiver pairs may be incorporated. One important aspect of the present invention is that the receiver must be kept blind to the transmitter, such that the receiver is unable to register a transmission signal $t_s$ from the transmitter as it is being transmitted there from. The receiver will therefore only receive the transmission signal $t_s$ when the signal is bounced off of a surface S or object referred to as a bounced signal $b_s$. In the present invention the receiver 134 is kept blind from the transmission signal $t_s$ by placing the transmitter 132 within a black tube 138 that is positioned adjacent to the receiver 134. Other means of blinding the receiver may be incorporated without effecting the scope of the invention.

The control system 130 may either be a closed loop system or an open loop system. In the closed loop system, the control system also monitors the speed of the propelling means (discussed in greater detail below). By monitoring the propelling means the control system can maintain a preset speed of the propelling means throughout the battery life, ensuring that the loss of battery power does not effect the speed of the propelling means and the hovering of the vehicle. In an open loop system, the control system does not monitor the speed of the propelling means but compensates for the power drain by slightly increasing the speeds over time. This can be accomplished by including a compensation timer on the circuit board that increases the speed of the propelling means as time increases.

In one embodiment, a hover speed is predetermined. The hover speed is determined by a number of factors such as the rotor assembly design, rotation of the propelling means, and weight of the entire vehicle. The hover speed will lift the vehicle off of a surface, such that when the speed of the rotating propelling means (referred to as rotor speed) is decreased slightly from the hover speed, the vehicle will decrease altitude or not lift off of the ground. Once the hover speed is determined the control system is given an upper range and lower range of rotor speeds. These include, in the least, a speed higher than hover speed to provide a climbing speed and a speed lower than hover speed to provide a fall speed. However, a range could also be established, for example, 5% above the hover speed for a climbing speed and 2% below the hover speed for fall speed.

Once the vehicle is activated, through a remote control or an on switch, the circuit board sends the vehicle into a climbing phase, by increasing the rotor speed to the climbing speed. In addition, the circuit board begins transmitting a signal. When the vehicle is close to a surface or object, the receiver will receive the transmission signal that is bounced off of the surface. As long as the receiver receives the signal, the circuit board maintains a climbing phase (FIG. 3*a*). As the vehicle moves further from the surface, the receiver will eventually lose the signal that is bounced off of the surface. At the moment the receiver loses the signal, the circuit board will switch to the fall speed and enter a deceleration phase. The control system may also decrement to the deceleration speed in steps, so the movement of the vehicle is not too severe. As the receiver regains the signal connection, the circuit board switches back to the climbing phase (again the control system may increment from the deceleration speed to the climbing speed to control the movement of the vehicle). Eventually, the vehicle will toggle back and forth between the deceleration and climbing phase as the signal strength rests on the fringe of being received and not received.

In the preferred embodiment, the transmitter transmits an infra-red frequency signal $t_s$. The circuit board monitors the receiver's output, in that upon detecting the signal bounced off of a surface the receiver's output is off (referred to as surface detected) and upon not detecting the signal the receiver's output is on (referred to as no surface detected). When the surface is detected for a predetermined time the propelling means is set to the climb speed and when the surface is not detected for a predetermined time the propelling means is set to the fall speed. Moreover, whenever there is a change in the receiver's output (from surface detected to surface not detected or visa versa) the propelling means is set to the hover speed.

FIG. 7 illustrates a process of controlling the vehicle. The process initially resets a timer, Step 200. The timer is used to time how long the receiver's output has been in a particular state. The receiver's output is monitored and checked to determine if a surface is detected, Step 205. If the receiver's output does not indicate a surface is detected, then the process goes to Step 255, where the output must be no surface detected.

Continuing from Step 205, the receiver's output is continually monitored to determine if there has been a change, Step 210. If there has been a changed, the propelling means 110 is set to hover speed and the timer is reset, Step 215. Since the receiver's output changed from surface detected to no surface detected, the process moves from Step 215 (out of the surface detected section) to Point A (into the no surface detected section, discussed in further detail below).

From Step 210, if the receiver's output has not changed, the process checks to see if the time is equal to a predetermined set time, Step 220. If the timer is not equal to the predetermined set time, then the process increments the timer, Step 225, and moves back to Step 210. If the timer is equal to the predetermined set time, then the propelling means 110 is set to the climb speed, Step 230.

Following Step 255 or Point A, when the receiver's output equals no surface detected, the receiver's output is checked to determine if there has been a change 260. If there has been a change in the output, the propelling means is set to hover speed and the timer is reset, Step 265. Since the receiver's output changed from no surface detected to surface detected, the process moves from Step 265 (out of the surface detected section) to Point B (into the surface detected section).

From Step 260, if the receiver's output has not changed, the process checks to see if the time is equal to a predetermined set time, Step 270. If the timer is not equal to the predetermined set time, then the process increments the timer, Step 275, and moves back to Step 260. If the timer is equal to the predetermined set time, then the propelling means 110 is set to the fall speed, Step 280. The process then goes back to Step 260 to monitor the output.

In the preferred embodiment, the two predetermined times $T_1$ and $T_2$ described on FIG. 7, may be the same time, such as 0.2 seconds. However, these times may also be different. By adjusting these two timers the size and position of all three speed ranges can be altered, relative to the maximum sensing distance.

From the hover state, as soon as the receiver's output detects the surface, the timer is started and if the receiver's output detects the surface for a first predetermined time (i.e. 0.2 seconds) the propelling means is set to climb speed. As long as the receiver's output is maintained to surface detected, the propelling means will remain set to the climb speed. As soon as the receiver's output is changed, the propelling means will be set to hover and the timer reset. If the receiver does not detects the surface for a second predetermined time (i.e. 0.2 seconds) the propelling means is set to fall speed. The propelling means will not change from a hover speed unless the receiver's output is maintained for at least the predetermined time. If the receiver's output is interrupted (meaning the receiver's output toggles or changes) within the predetermined time, the timer is reset.

Once the vehicle is in a hover position, if the user places an object between the surface and the bottom of the vehicle (for example, the user's hand, FIG. 3*c*), the vehicle will sense the transmission being bounced off of the object and enter into a climbing phase until the vehicle is the predetermined distance from the object. Similarly, if the vehicle is hovering above the object and the object changes its altitude, the vehicle will adjust itself accordingly, by entering the deceleration or climbing phase, depending upon whether the object moved closer to or further away from the vehicle.

Figure 3B:
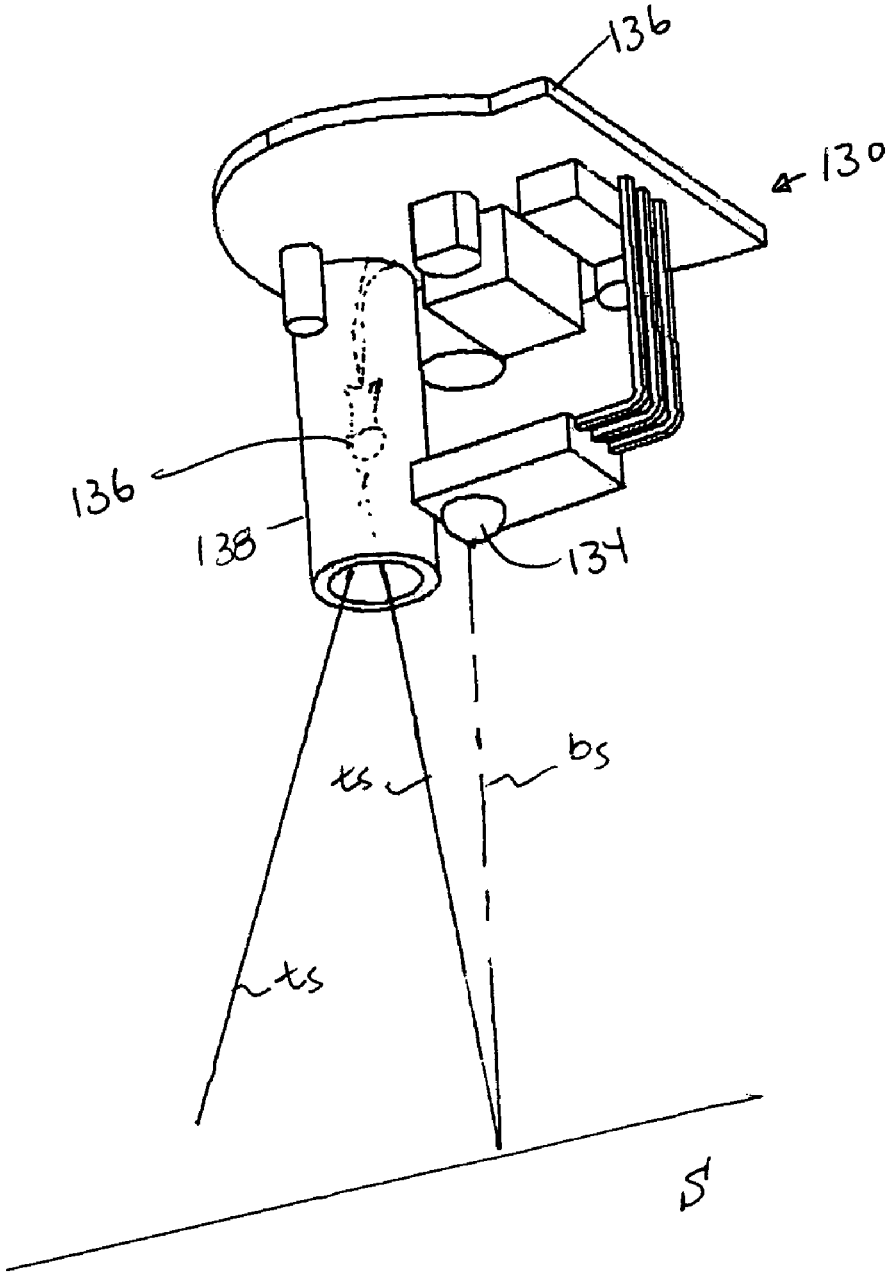
FIG. 3*b* is the hovering control system of FIG. 3*a* illustrating an intermittent signal.
Figure 3C:
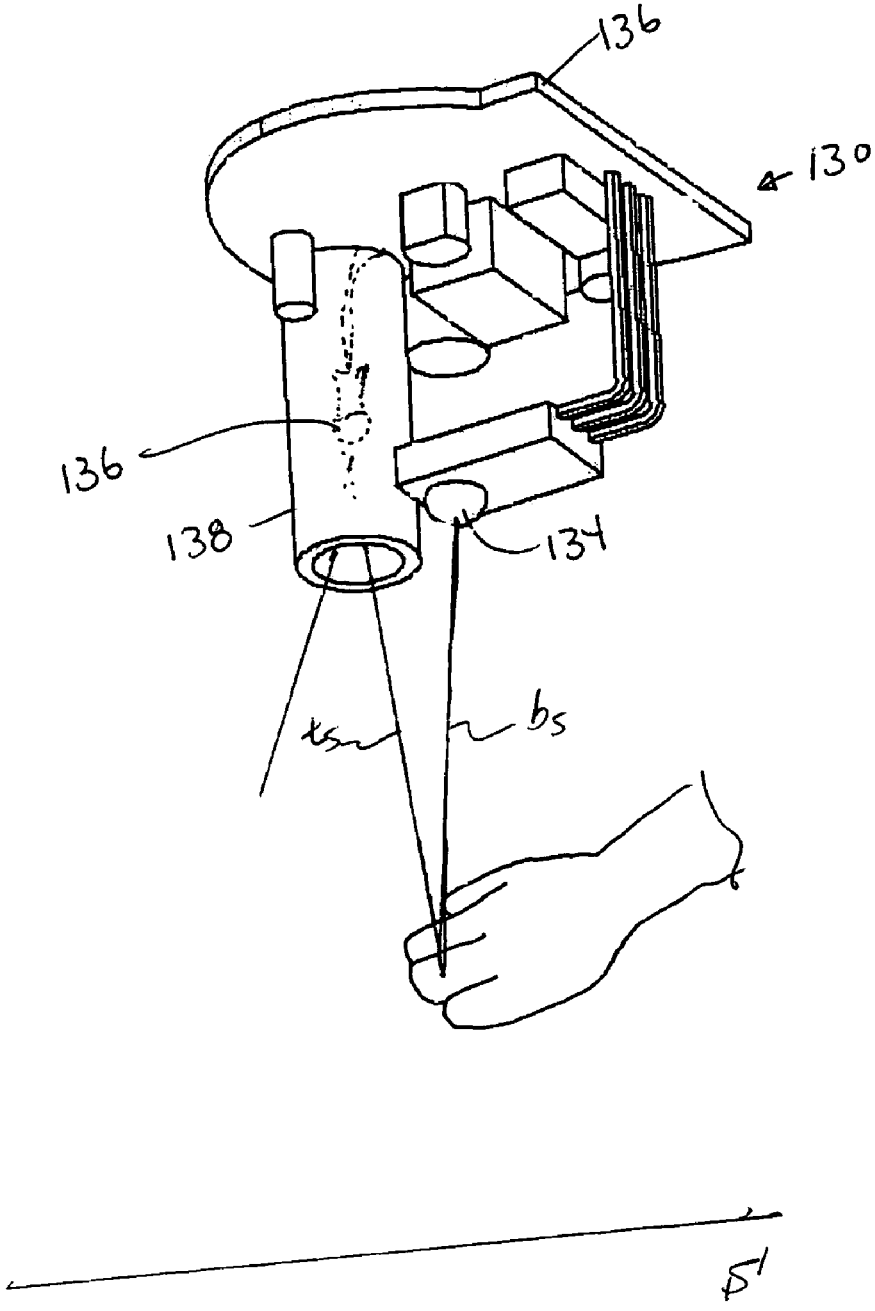
FIG. 3*c* is the hovering control system of FIG. 3*a* illustrating the signal being bounced off of the surface of an object.
Figure 4:
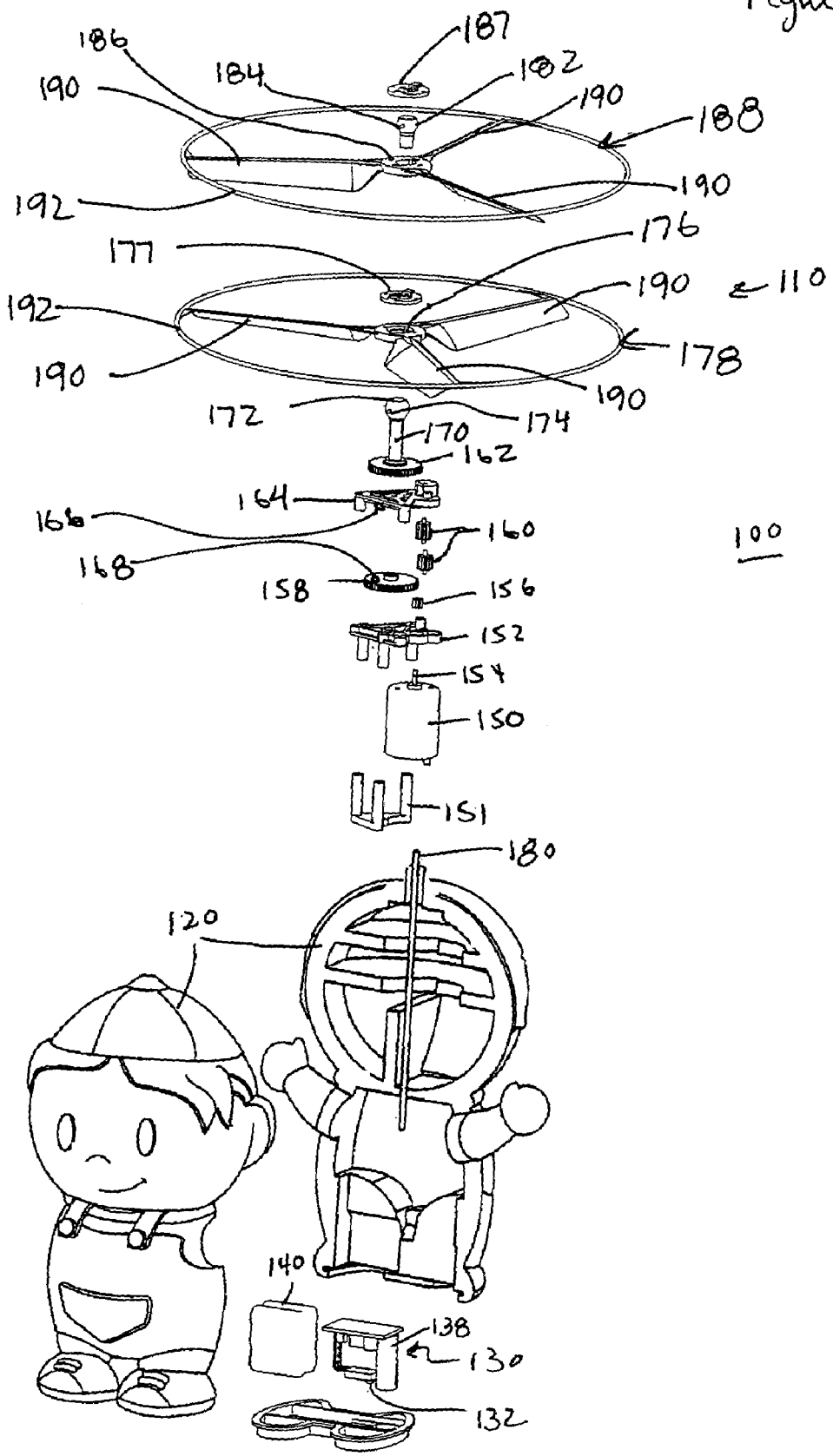
FIG. 4 is an exploded view of FIG. 1.

In another aspect of the present invention the control system can adjust the speed of the propeller means 110 depending upon the signal strength received by the receiver 132. At that point, the vehicle will hover at a predetermined distance from the surface (FIG. 3*b*). The predetermined distance from the surface is determined mostly by the signal strength. A strong transmission signal will cause the vehicle to move further away from the surface until the bounced signal becomes too faint or weak such that the control system toggles between the deceleration and climbing phases.

In a broad aspect of the invention the control system moves or flies a vehicle. A transmitter/receiver pair is positioned on the vehicle and the transmitter transmits a signal from the vehicle in a specified direction. When the signal is bounced off of a surface (including a surface of an object) and received back by the receiver, the control system flies the vehicle in a direction opposite to the specified direction. In addition, when the receiver does not receive the signal, the control system flies the vehicle in the specified direction. For the example discussed above, the direction in downwardly, such that the control system will hover the vehicle above a surface. However, if the vehicle had directional controls, the control system could be positioned on the side of the vehicle such that the vehicle would be capable of keeping a predetermined distance away from a wall or a surface of a wall (including any objects positioned along the wall).

Referring again to FIG. 1, to assist in the vehicles stability in the hover, the propelling means 110 includes a means of stabilizing the vehicle 100 in a horizontal position. The propelling means 110 is secured to the top portion 105 of the vehicle body 120. In the embodiment illustrated, the body 120 is a character or figure. The propelling means 110 is a counter rotating propeller mechanism, since the body 120 does not include additional means to counter the torque of a motor included thererin and this specific embodiment does not call for the rotation of the body.

Turning now to FIGS. 4 through 7, the propelling means 110 includes a motor 150 attached to a body mount 151 and secured to a lower gear housing 152. The motor 150 drives a motor shaft 154 that has a drive gear 156 attached thereto. The drive gear 156 is meshed to a first spur 158 and idler gears 160. The idler gears 160 do not effect the gear ratio but will change the direction such that a second spur 162 meshed to the idler gears 160 is rotating in the opposite direction as the first spur 158. The second spur 162 is mounted above an upper gear housing 164.

In the present embodiment, the control system is a closed loop system requiring the control system to monitor the speed of the rotor. The monitoring of the speed is accomplished by including a hall effect sensor 166 mounted to the upper gear housing 164 and a magnet 168 is mounted to the first spur 158. As the first spur 158 rotates, the revolutions per second are calculated providing the ability to calculate speed.

Secured to the second spur 162 is a rod 170 that has a lower ball joint 172 secured on its end. The lower ball joint 172 includes a pair of pins 174 extending outwardly therefrom. The lower ball joint 172 is secured to a lower propeller mount 176. The lower propeller mount 176 pivotally attaches a lower rotor assembly 178 to the lower ball joint 172.

The rod 170 and the lower ball joint 172 are bored there-through to permit the passage of a drive shaft 180 that is secured to the first spur 158, such that the drive shaft rotates along with and in the same direction of the rotation of the first spur 158 without effecting the opposite rotation of the second spur 162. The drive shaft 180 traverses through the lower propeller mount 176 and has an upper ball joint 182 with pins 184 secured on its end. The upper ball joint 182 is secured to an upper propeller mount 186. The upper propeller mount 186 pivotally attaches an upper rotor assembly 188 to the upper ball joint 182.

Figure 5A:
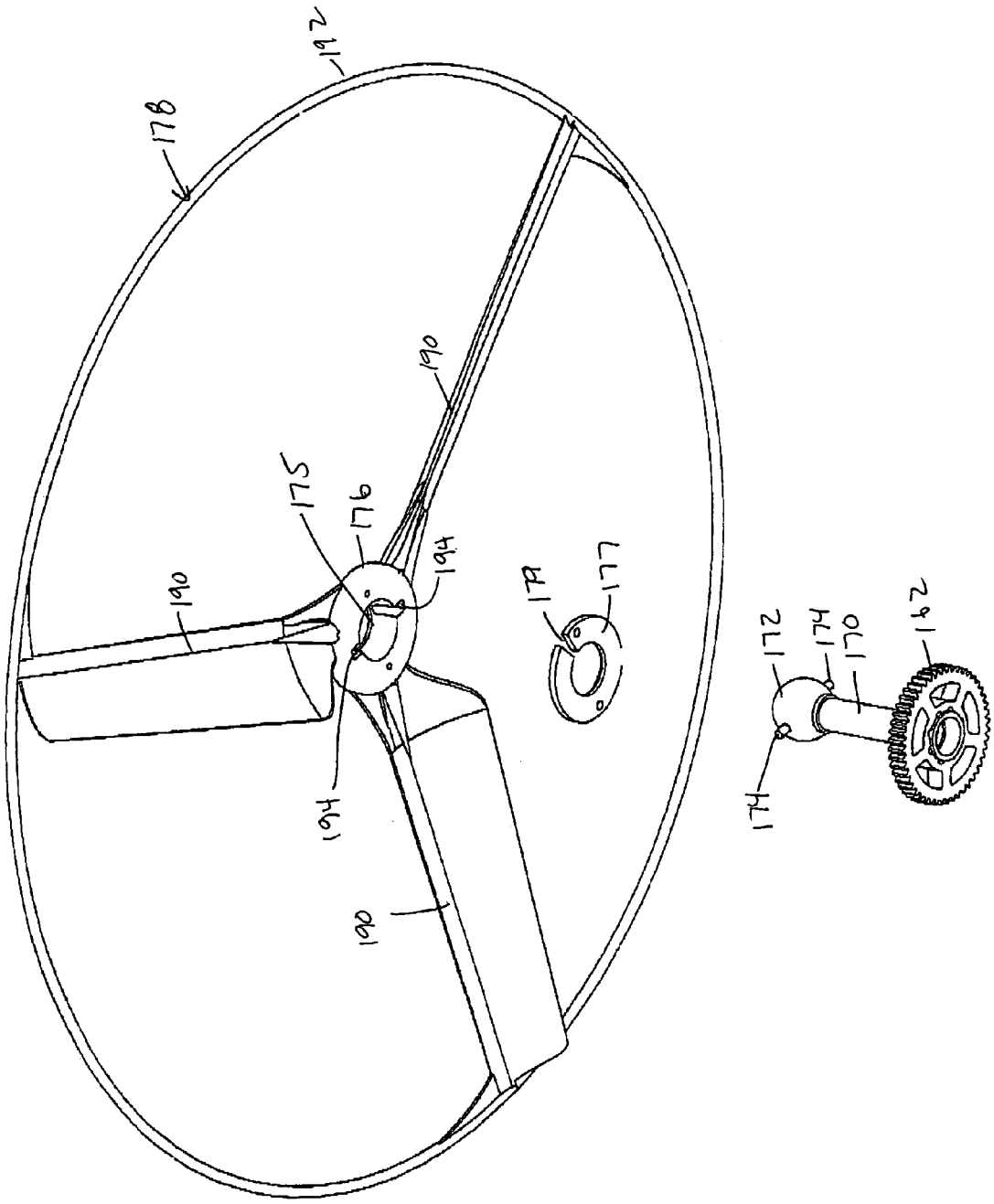
FIG. 5*a* is an exploded enlarged view of the lower rotor assembly.
Figure 5B:
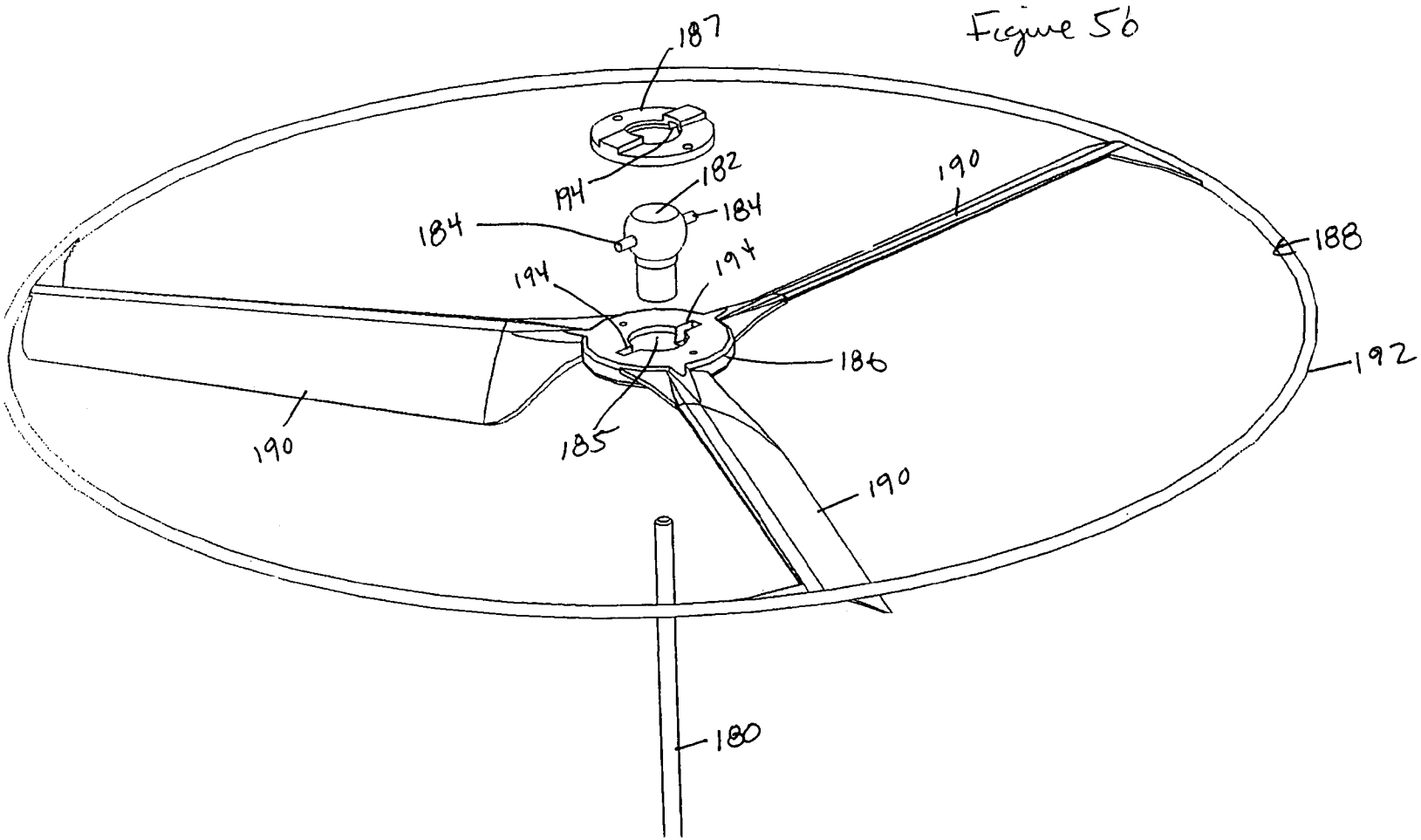
FIG. 5*b* is an exploded enlarged view of the upper rotor assembly.

Both the lower and upper rotor assemblies include a plurality of blades 190 extending from its respective propeller mount. The ends of each blade are further connected to a safety ring 192. Each propeller mount further includes a cap. In FIG. 5*a* the lower cap 177 includes a notch 179 to permit the lower cap 177 to fit around the rod 170. The lower cap 177 is secured to the lower propeller mount 176 capturing lower ball joint 172 in an aperture 175 defined in the center of the lower propeller mount 176, with the pins 174 positioned in channels 194. In FIG. 5*b*, an upper cap 187 is secured to the upper propeller mount 186 capturing the upper ball joint 182 in an aperture 185 defined on the upper propeller mount 186. The pins 184 on the upper ball joint 182 are positioned in channels 194 defined on the upper propeller mount 186.

Figure 6A:
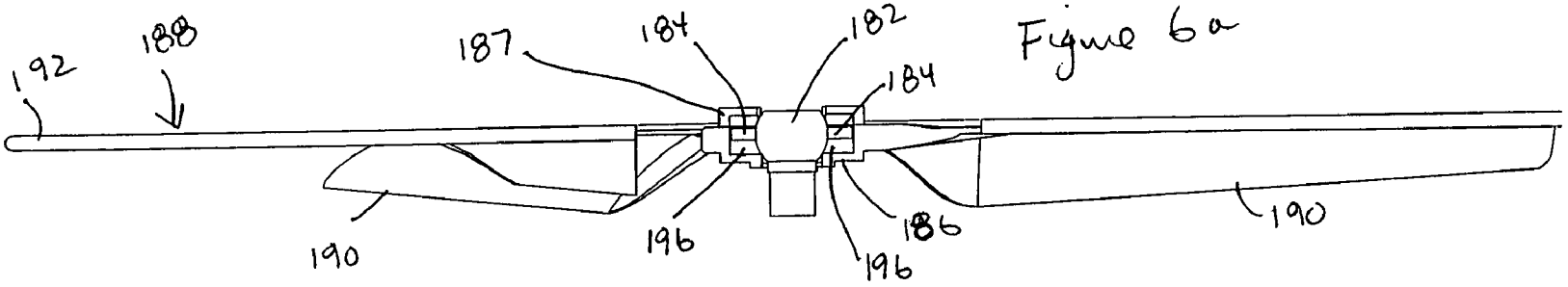
FIG. 6*a* is a sectional view of the upper rotor assembly.
Figure 6B:
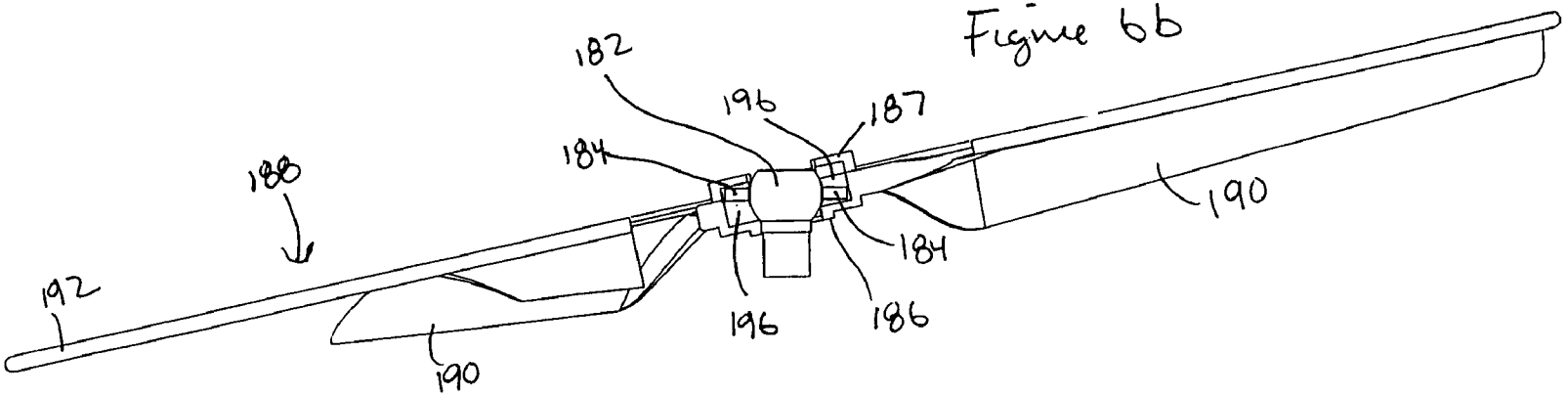
FIG. 6*b* illustrates the upper rotor assembly from FIG. 6*a* showing the pitch limiting means.

While each rotor assembly works in the same manner, FIGS. 6*a* and 6*b* only reference numerals to the upper rotor assembly 188, while the following discussion pertains to both the upper rotor assembly 188 and the lower rotor assembly, only numerals to the upper rotor assembly are made. This is not done to limit the scope of the invention.

The ball joints 182 are unique because when the ball joints 182 rotate, the pins 184 extending into the channels 194 to drive the rotor assemblies 188. However, the channels 194 are sized such if the rotor assembly 188 pitches slightly or the body 120 of the vehicle 100 moves, the pins 184 have clearance to permit the ball joint 182 to move in any plane perpendicular to the plane of the rotor assembly 188. This free movement of the ball joint 182 aids in horizontally stabilizing the rotor assembly 188 while maintaining a vertically aligned body.

The ball joint 182 is a simple pivot that allows the rotor assembly 188 to include more than two blades 190. If only two blades 190 were included opposed from one another, then the rotor assembly 188 would need to pivot in just one axis (parallel to the blades) to level out. But the ball joint 182 allows the rotor assembly 188 to pivot in a number of different directions and thus allows for any number of blade 190 configurations, by creating a pivoting plane about each blade 190. If the rotor assembly 188 begins to pitch, the blades 190 and safety ring 192 will begin to move off of a horizontal plane. The ball joint 182 permits the rotor assembly to freely pivot about the rod or drive shaft independently from the body of the vehicle, wherein when the rotor assembly is rotating and begins to pitch, the rotating rotor assembly having a centrifugal force created by the rotation thereof will tend to pivot about the ball joint in a manner that offsets the pitch such that the vehicle remains in a substantially horizontal position. As such the ball joint 182 and the rotor assembly 188 horizontally stabilize the rotating rotor assembly.

The ball joint 182 also keeps the body of the body 120 vertically straight during flight. The ball joint 182 and the weight of the body 120 will automatically pull the body 120 back to a straight vertical position because of gravity. If the body 120 touched something and the rotor assembly 188 was rigidly attached to the body, then the resulting tilt of the center axis would cause the whole vehicle to propel itself at that angle instead of straight upwards.

Lastly, while the rotor assembly 188 is pitching, the pins 184 extending from the ball joint 182 move inside the channels 194 until the pins 184 come into contact with the interior walls of the channels 194 (FIG. 6*b*). This pitch limiting means prevents the pitch of the rotor assembly 188 becoming too extreme, which could happen with a large gust of wind. In addition, if the counter rotating rotor assemblies did not have safety rings, it would be possible for a blade from the lower rotor assembly to contact and entangle with a blade from the upper rotor assembly which would be detrimental to the flying vehicle. The pitch limiting means defined and described above would prevent the rotor assemblies from colliding.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred.

We claim:

1. A vehicle having a means for propelling in a vertical direction, further comprising:

a transmitter positioned on the bottom of said vehicle for transmitting a signal from the vehicle downwardly away from said vehicle;

a receiver positioned on the bottom of said vehicle for receiving said signal as it is bounced off of a surface, defined as a bounced signal; and a control system that automatically sets a speed of the propelling means in response to the receiver, said control system having a first means to set the speed of the propelling means to a first speed when the receiver receives the bounced signal and the control system having a second means to set the speed of the propelling means to a second speed when the receiver does not receive the bounced signal, the first speed being predefined as a speed that causes the vehicle to gain altitude and the second speed being predefined as a speed that causes the vehicle to lose altitude.

2. The vehicle of claim 1, wherein the receiver is positioned such that the receiver is blind to the signal transmitted from the transmitter and is only capable of receiving said bounced signal.

3. The vehicle of claim 2, wherein the transmitter is recessed in a tube.

4. The vehicle of claim 1, wherein the control system further monitors the speed of the propelling means by incorporating a hall effect sensor mounted to the vehicle used in conjunction with a magnet mounted to a rotating propeller defined by the propelling means, wherein by monitoring the speed of the propelling means, the control system can maintain the speed of the propelling means as defined by the first speed and the second speed.

5. The vehicle of claim 1, wherein the control system further includes a means to increment the first speed and second speed as functions of time.

6. A flying vehicle comprising: of claim 1 comprising:

a body;

said propelling means comprising:

a rotating propeller assembly secured to a top portion defined by the body, the propeller assembly includes a centered propeller mount with at least one blade extending from said centered propeller mount, the centered propeller mount includes an aperture and a channel extending away from the aperture; and a ball joint driven by a motor mechanism, the ball joint is received in said aperture and the ball joint has a pin extending therefrom into the channel, such that when the ball joint is rotating, the pin contacts an interior portion of the channel driving the propeller assembly, and wherein the ball joint and the centered propeller mount permit the rotor assembly to freely pivot about the ball joint independently from the body of the vehicle, wherein when the rotor assembly is rotating and begins to pitch, the rotating rotor assembly having a centrifugal force created by the rotation thereof will tend to pivot about the ball joint in a manner that offsets the pitch such that the vehicle remains in a substantially horizontal position.

7. The vehicle of claim 6 wherein when the rotor assembly begins to pitch, the pin of the ball joint contacts an interior portion of the channel to limit the pitch of the rotor assembly.

8. The vehicle of claim 6 wherein the propeller assembly includes an odd number of blades, and wherein the ball joint and the propeller mount permit the propeller assembly to pivot in any plane perpendicular to the blades.

9. The vehicle of claim 6, wherein the rotating propeller assembly is defined by having stacked counter rotating rotor assemblies and wherein the channels defined on each of said counter rotating rotor assemblies are sized to prevent blades defined by each counter rotating rotor assemblies from contacting one and other.

10. A system to control a direction of movement of a flying vehicle, the control system comprising:

a transmitter/receiver pair positioned on the vehicle, the transmitter transmitting a signal from the vehicle in a predetermined direction;

a means to fly said vehicle in a direction opposite of said predetermined direction when said signal is bounced off of a surface and received back by the receiver; and a means to fly said vehicle in a direction similar to said predetermined direction when said receiver does not receive said signal.

11. The system of claim 10, wherein the receiver is positioned such that the receiver is blind to the signal transmitted from the transmitter and is capable of receiving said signal when bounced off of the surface.

12. The system of claim 11, wherein the transmitter/receiver pair is orientated such that the signal is transmitted downwardly away from the vehicle.

13. The system of claim 6 further comprising a means for propelling the vehicle in a horizontal direction.

14. The system of claim 13 further comprising a means to monitor a speed of propelling means.

15. The system of claim 13 further comprising a means to increase a speed of the propelling means as a function of time.

16. A process of controlling an altitude of a flying vehicle having a vertical propelling means in a vertical direction comprising:

providing a hover speed of said propelling means that has a tendency to maintain the vehicle at a substantially constant altitude;

transmitting a signal downwardly away from said vehicle;

providing a means for receiving said signal as it is bounced off of a surface, monitoring said receiving means and adjusting said propelling means in response to the following:

when said receiving means does not receive said bounced signal adjusting, said propelling means to a speed lower than said hover speed, and when said receiving means receives said bounced signal, adjusting said propelling means to a speed higher than said hover speed.

17. The process of claim 16 further comprising:

monitoring said receiving means and adjusting said propelling means in response to the following:

when said receiving means does not receive said bounced signal for a first predetermined time adjusting said propelling means to a speed lower than said hover speed, when said receiving means receives said bounced signal for a second predetermined time adjusting said propelling means to a speed higher than said hover speed, and adjusting said propelling means to the hover speed when said receiving means changes for receiving said bounced signal to not receiving said bounced signal and visa versa.

* * * * *